US005813121A

United States Patent [19]

Gringer

[11] Patent Number: 5,813,121

[45] Date of Patent: Sep. 29, 1998

[54] AUTOMATICALLY RETRACTABLE UTILITY KNIFE

[75] Inventor: Donald Gringer, New York, N.Y.

[73] Assignee: Allway Tools, Inc., Bronx, N.Y.

[21] Appl. No.: 664,683

[22] Filed: Jun. 17, 1996

[51] Int. Cl.[6] ..... B26B 1/08

[52] U.S. Cl. ..... 30/162; 30/335

[58] Field of Search ..... 30/151, 162, 335

[56] References Cited

U.S. PATENT DOCUMENTS

| | | | |
|---|---|---|---|
| D. 319,378 | 8/1991 | Wilcox . | |
| 1,315,901 | 9/1919 | Ballinger | 30/159 |
| 1,603,914 | 10/1926 | Hermann | 30/159 |
| 1,864,011 | 6/1932 | Brown | 30/155 |
| 3,132,371 | 5/1964 | Enos et al. . | |
| 3,192,624 | 7/1965 | Gringer | 30/162 |
| 3,879,847 | 4/1975 | Roll | 30/162 |
| 3,906,627 | 9/1975 | Manning | 30/162 |
| 4,139,939 | 2/1979 | Crooks . | |
| 4,242,795 | 1/1981 | Rollband et al. | 30/162 |
| 4,621,425 | 11/1986 | Stoutenberg | 30/162 |
| 4,835,865 | 6/1989 | Knoop | 30/162 |
| 5,012,581 | 5/1991 | Fletcher et al. | 30/162 |
| 5,025,558 | 6/1991 | Gilbert | 30/162 |
| 5,031,322 | 7/1991 | Jacoff | 30/162 |
| 5,121,544 | 6/1992 | Gilbert | 30/162 |
| 5,164,871 | 11/1992 | Hughes et al. . | |
| 5,481,804 | 1/1996 | Platts | 30/162 |
| 5,581,890 | 12/1996 | Schmidt | 30/162 |

FOREIGN PATENT DOCUMENTS

| | | | |
|---|---|---|---|
| 3520187 | 12/1986 | Germany | 30/162 |

*Primary Examiner*—Hwei-Siu Payer

*Attorney, Agent, or Firm*—David M. Klein; Shearman & Sterling

[57] ABSTRACT

An automatically retractable utility knife includes a housing and a blade carrier having an integrally molded return spring. The return spring is serpentine shaped and constructed of a resilient thermoplastic. A method of manufacturing a utility knife includes the steps of providing a housing having an interior adapted to receive either an indexed blade carrier or an automatically retractable blade carrier, and assembling the housing with either an indexed blade carrier or an automatically retractable blade carrier therein. A locking mechanism for a utility knife includes a resilient locking arm on a first half of the housing, the locking arm having i) an upstanding portion oriented generally perpendicular to an axis of the housing, ii) an actuating arm extending laterally from a free end of the upstanding portion, so that downward force on the actuating arm causes a bending of the upstanding portion, and iii) a locking lip on the free end of the upstanding portion extending laterally in a direction opposite to the direction of bending of the upstanding portion. The second half of the housing includes a locking aperture, and a locking shoulder adjacent to the locking aperture. The locking arm and locking aperture are positioned to become aligned when the halves of the housing are aligned for assembly. The locking mechanism is released by pulling the halves apart in opposite directions generally perpendicular to the housing axis once the actuating arm has been depressed.

8 Claims, 14 Drawing Sheets

AUTOMATICALLY RETRACTABLE UTILITY KNIFE

BACKGROUND OF THE INVENTION

1. Field of the Invention

The present invention relates to an automatically retractable utility knife, and more particularly to an automatically retractable utility knife in which the blade carrier is integrally molded with the retraction spring, and in which the blade housing is adapted to receive either automatically retractable or indexed blade carriers.

2. Description of the Related Art

Utility knives are well known in the art, such as those shown in U.S. Pat. Nos. 5,121,544; 5,025,558; and 4,621,425. Utility knives are typically constructed of a hollow housing having a slidable internal razor blade carrier on which a razor blade is mounted. A thumb piece is connected to the blade carrier and extends exteriorly of the housing through a slot in the housing. Using the thumb piece, the blade may be extended out of the housing through a slot at a distal end of the housing, and retracted into the housing. Most utility knives are indexed, i.e., the blade may be moved between one of several latched positions, including fully retracted and fully extended positions.

Another type of well-known utility knife is the automatically retractable type, in which the blade is normally retracted in the housing and requires continuous application of pressure by the user on the thumb piece for the blade to remain in the projected position. A spring attached between the housing and the blade carrier automatically retracts the blade upon release of the external thumb mechanism. The spring tension is such that when the blade is projected and is inserted into a material being cut, e.g., cardboard, the friction between the blade and the material is sufficient to retain the blade in the projected position. Automatically retractable utility knives are shown, for example, in U.S. Pat. Nos. 4,139,939 and 5,012,581. These types of utility knives are expensive to manufacture due to the cost of the spring and are difficult to assemble because the spring must be secured between the blade carrier and housing. Also, the housings of conventional automatically retractable utility knives are not adapted to receive indexed blade carriers, thereby necessitating the use of separate molds for indexed knives and automatically retractable knives.

In most retractable utility knives, the housing is constructed of two halves which are locked together by means of a screw located toward the center of the housing. In order to replace the blade, it is necessary to unscrew the halves of the housing, which requires a screwdriver, and which is both time consuming and inconvenient. To overcome this shortcoming, utility knives with plastic housings have been developed which incorporate locking mechanisms that may be released without tools. For example, U.S. Pat. No. 5,121,544 (embodied in the Stanley™ Model 10-165 retractable utility knife) relates to a retractable utility knife that is constructed of separable plastic halves and includes a rear snap-locking mechanism. In order to operate the locking mechanism, the user must push an actuating lever and slide the halves in opposite directions generally parallel to a central axis of the housing, i.e., generally parallel to the direction of movement of the blade, before they release from each other. This locking mechanism is difficult to operate.

Accordingly, it would be desirable to have a utility knife housing which is adapted to receive automatically retractable or indexed blade carriers so that the utility knife housing may be used for either application.

It would also be desirable to have an automatically retractable utility knife in which the blade carrier is integral with the retraction spring so as to reduce the cost and complexity of manufacture.

Finally, it would be desirable to have a utility knife with a hand-operated release mechanism that is inexpensive to manufacture and simple to use.

SUMMARY OF THE INVENTION

The present invention is an automatically retractable utility knife which includes a housing and a blade carrier disposed within the housing, the blade carrier having an integrally molded return spring. The return spring is preferably serpentine shaped and constructed of an acetal resin or other resilient thermoplastic. The housing includes a guide slot and the blade carrier comprises a thumb piece extending through the slot for facilitating movement of the blade carrier in the housing to extend and retract a razor blade. A spring securing pin is fixed to the housing for securing a free end of the return spring.

A method of manufacturing a utility knife includes the steps of providing a housing having an interior adapted to receive either an indexed blade carrier or an automatically retractable blade carrier, and assembling the housing with either an indexed blade carrier or an automatically retractable blade carrier therein. The housing is constructed of separable halves, and the step of assembling the housing involves the steps of installing the blade carrier in one of the housing halves, and connecting the separable halves to form the housing. The housing includes a plurality of locking apertures, and the indexed blade carrier comprises a locking protuberance that engages with the locking apertures to enable the indexed blade carrier to be moved to a plurality of positions within the housing.

For assembly of the housing with an automatically retractable blade carrier, the housing includes a spring securing pin. A retraction spring is inserted between the automatically retractable blade carrier and the spring pin during assembly. The retraction spring and the automatically retractable blade carrier may be integrally molded.

Also provided is a locking mechanism for a utility knife having a housing constructed of first and second separable halves. The housing has an axis that extends between the front and rear ends thereof. The locking mechanism includes a resilient locking arm on the first half of the housing, the locking arm comprising i) an upstanding portion oriented generally perpendicular to the housing axis, the locking arm having a first end attached to the first half of the housing and a second end, ii) an actuating arm extending laterally from the second end of the upstanding portion, whereby downward force on the actuating arm results in a bending of the upstanding portion, and iii) a locking lip on the second end of the upstanding portion extending laterally in a direction opposite to the direction of bending of the upstanding portion during downward force on the actuating arm. The second half of the housing comprises a locking aperture sized to receive the second end of the locking arm, and a locking shoulder adjacent to the locking aperture. The locking arm and locking aperture are correspondingly positioned so as to become aligned when the halves of the housing are aligned for assembly. During assembly, the locking arm extends into the locking aperture and the locking lip positively locks on the locking shoulder. Thus, the locking mechanism is actuated by pressing the halves together in opposite directions generally perpendicular to the axis of the housing, and released by application of downward force on the actuating arm and by pulling the housing halves in opposite directions generally perpendicular to the axis of the housing.

DETAILED DESCRIPTION OF THE INVENTION

Figure 1:
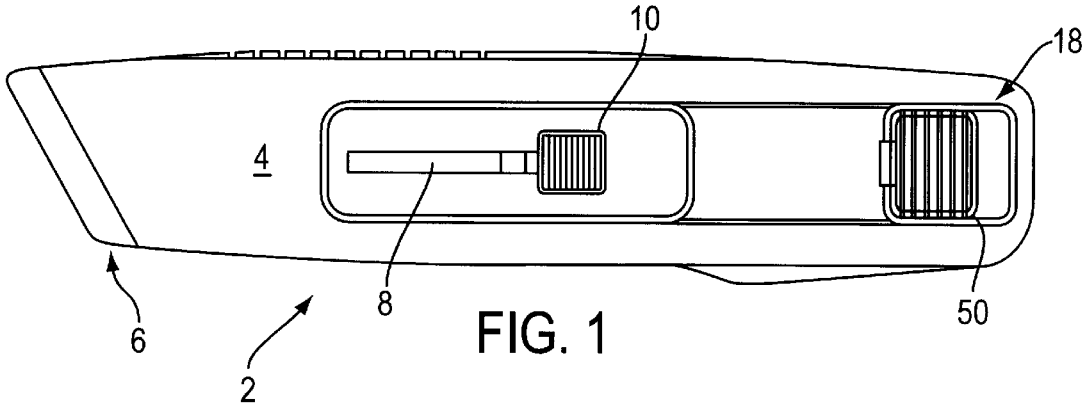
FIG. 1 is a top view of an indexed retractable utility knife in accordance with the invention.
Figure 2:
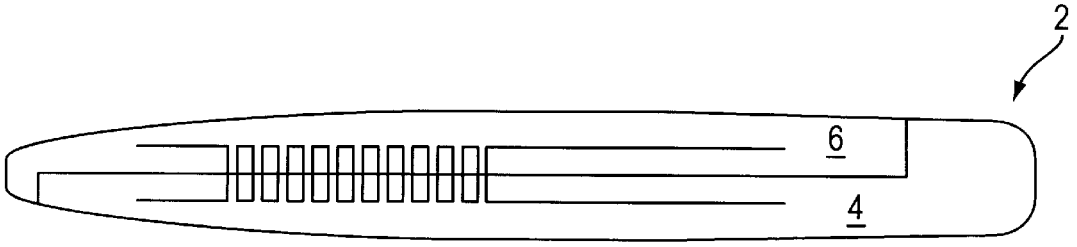
FIG. 2 is a side view of the utility knife shown in FIG. 1.
Figure 3:
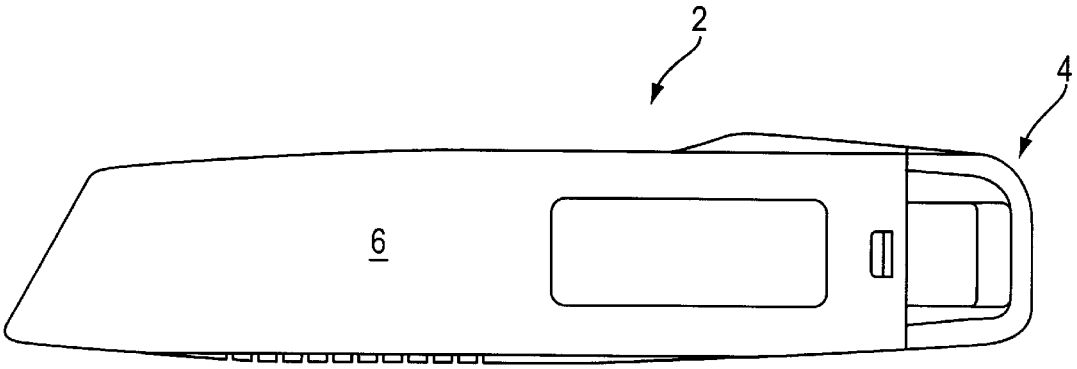
FIG. 3 is a bottom view of the utility knife shown in FIG. 1.
Figure 4:
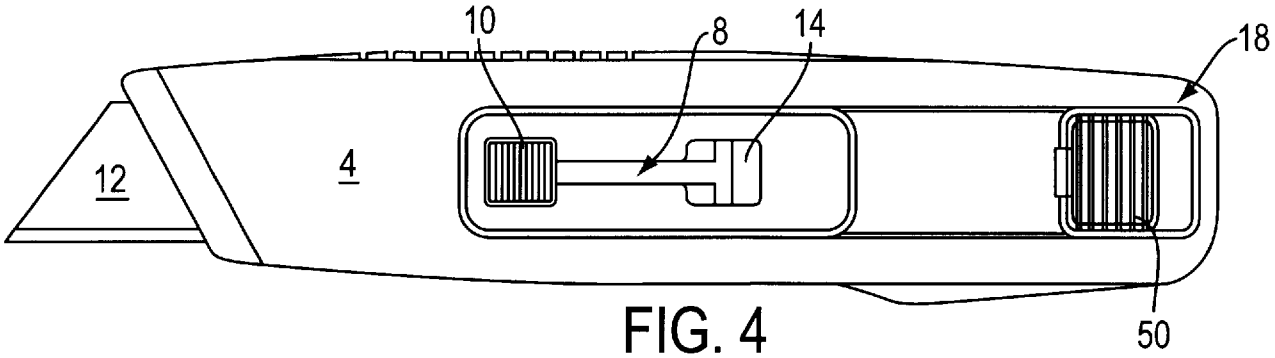
FIG. 4 is a top view of an indexed retractable utility knife with the blade in the extended position.
Figure 5:
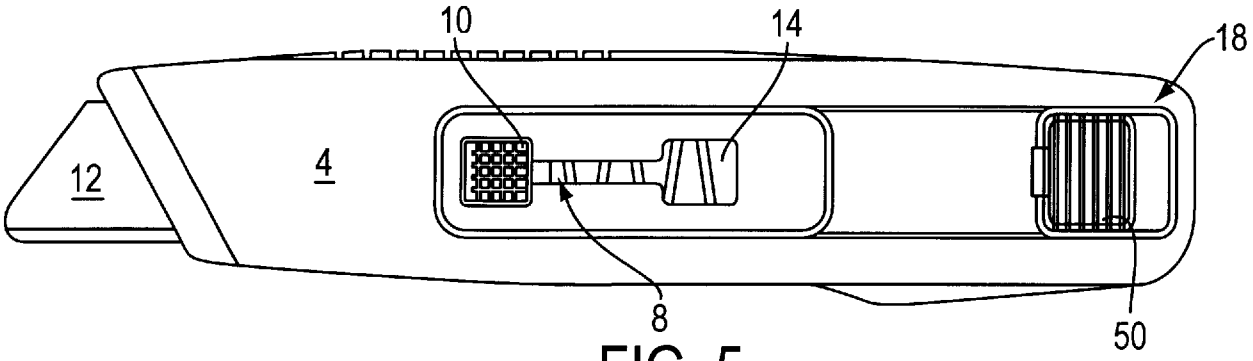
FIG. 5 is a top view of an automatically-retractable utility knife with the blade in the extended position.
Figure 6:
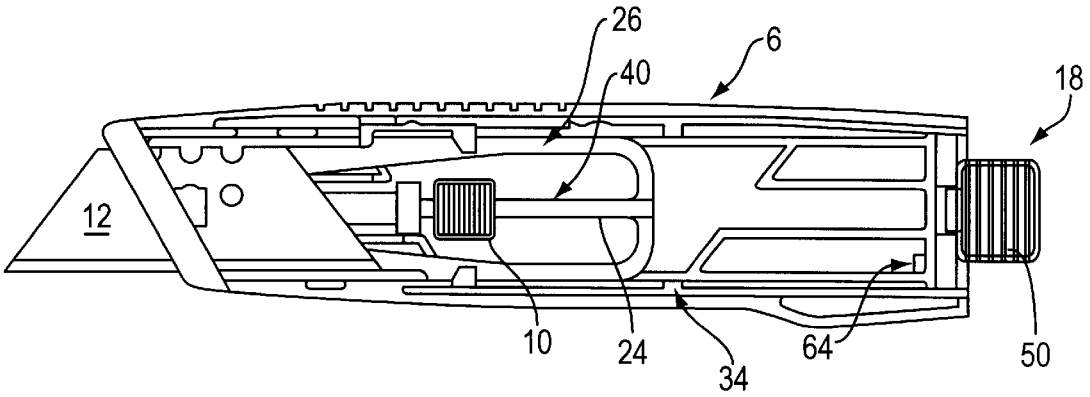
FIG. 6 is a top view of an indexed utility knife with the blade in the exposed position and with the upper housing removed.
Figure 7:
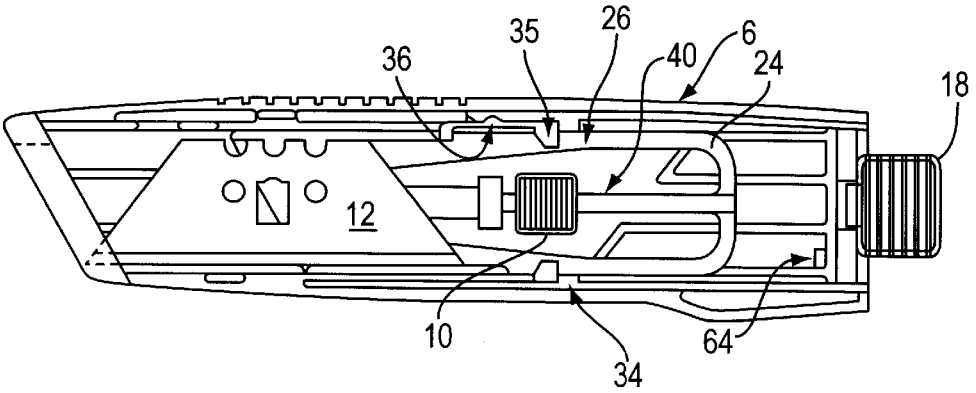
FIG. 7 is a top view of an indexed utility knife with the blade in the retracted position and with the upper housing removed.

As shown in FIGS. 1–6, the present invention is a utility knife having a housing 2 that is constructed of an upper housing 4 and a lower housing 6. Upper housing 4 includes a slot 8 extending therethrough. A thumb piece 10 is preferably integral with the blade carrier (discussed below) and extends through slot 8 so that movement of the thumb piece along the slot by the user causes projection and retraction of cutting blade 12, which may be either of the type having rounded edges (FIG. 8) or sharp edges (FIG. 7). One end of slot 8 forms an enlarged opening 14 with dimensions larger than thumb piece 10 to enable thumb piece 10 to be inserted therethrough during assembly.

Housing 4 is adapted to accept either an automatically retractable blade carrier 22, such as that shown in FIGS. 8–10 and 43–49; or an indexed-typed blade carrier 24, such as that shown in FIGS. 6–7 and 36–42. Each type of blade carrier 22 or 24 rides on and is supported by carrier guides 20 and includes blade retention projections 56 and guides 58 for supporting the razor blade. Lower housing 6 also includes support platforms 28 which support the blade carrier 22 or 24 through its range of movement in housing 2. Support platforms 28 taper toward the distal end 30 of housing 2 in order to align razor blade 12 with slot 32 on the distal end of the housing. Lower housing 6 also includes detents 34 that contact carrier end stops 35 to prevent rearward movement of the blade carrier beyond the detents (see FIGS. 7 and 10). Carrier end stops 35 ride on and are supported by support shoulders 37.

Figure 25:
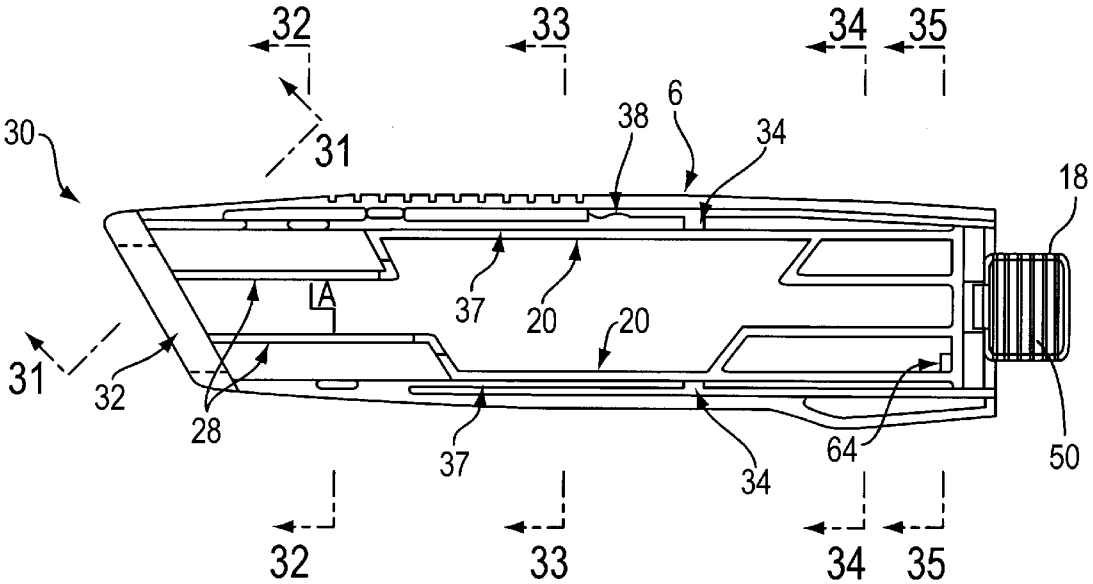
FIG. 25 is a view of the interior side of the lower housing.
Figure 36:
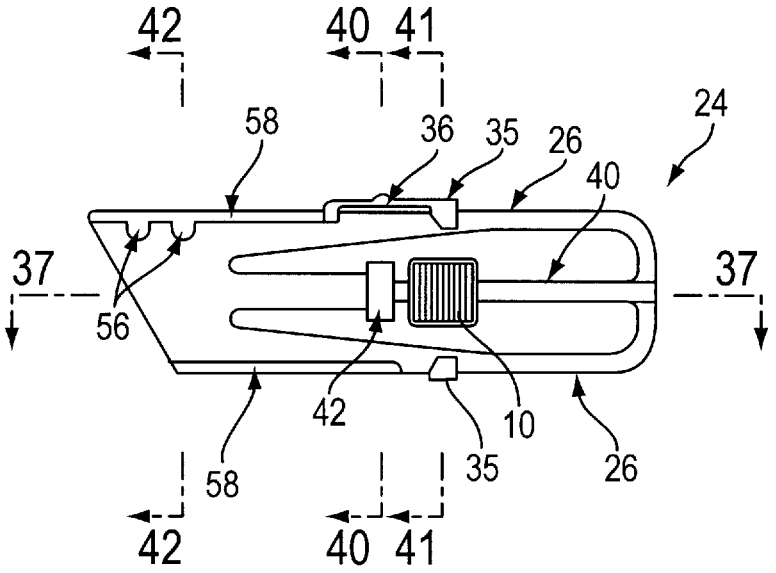
FIG. 36 is a top view of an indexed blade carrier.

As shown in FIGS. 7, 25, and 36, indexed blade carrier 24 includes a resiliently biased rear position lock 36 that snaps into a correspondingly shaped rear position cutaway 38 on lower housing 6 to secure the blade carrier in the lower housing when the blade carrier is in the rearmost position and the upper housing is removed. Rear position lock 36 frictionally engages with rear position cutaway 38 so that carrier 24 is held in place when the housing is opened, although carrier 24 may be removed with minimal effort for obtaining access to the blade storage area therebelow.

Figure 23:
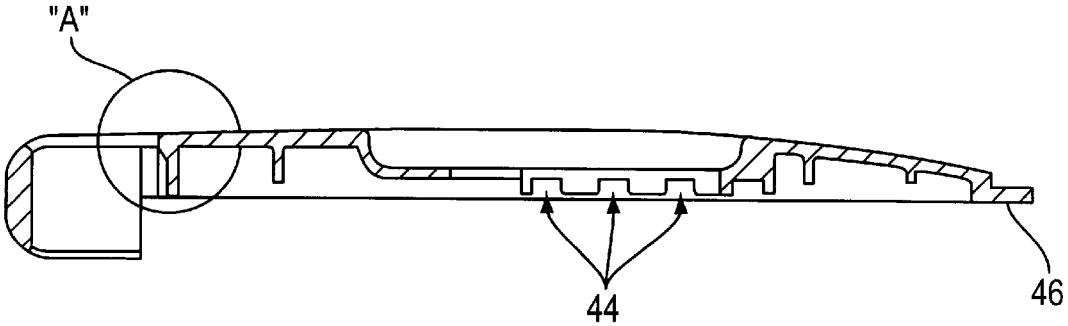
Figure 30:
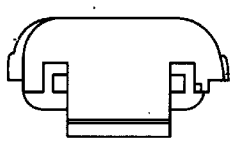
FIG. 30 is an opposite end view of the lower housing shown in FIG. 25.
Figure 37:
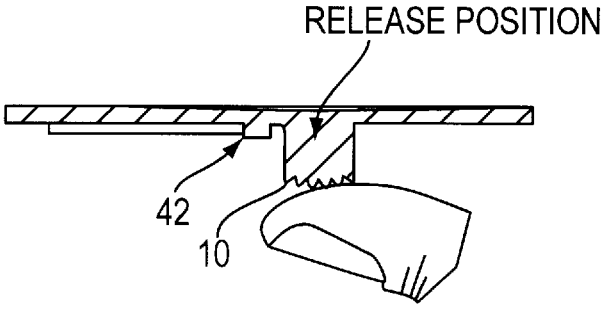
FIGS. 37 and 38 are partial cross-sectional views through Section 37—37 of FIG. 36 showing the blade carrier in a released position (FIG. 37) and in a locked position (FIG. 38).
Figure 38:
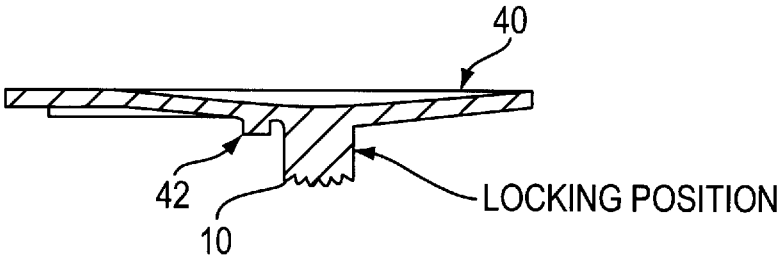
Figure 39:
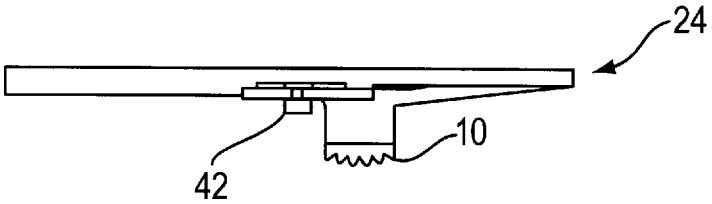
FIG. 39 is a side view of the blade carrier shown in FIG. 36.
Figure 40:
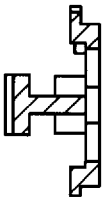
FIGS. 40–42 are cross-sectional views through the corresponding Sections shown in FIG. 36.
Figure 41:
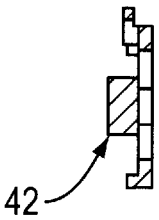
Figure 42:
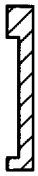
Figure 43:
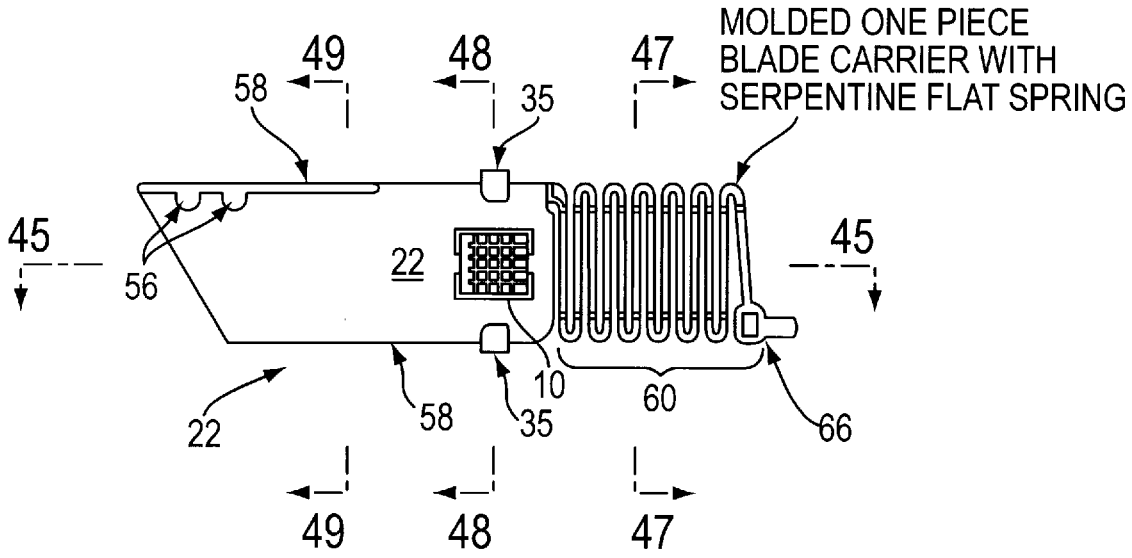
FIG. 43 is a top view of an automatically-retractable blade carrier.
Figure 44:
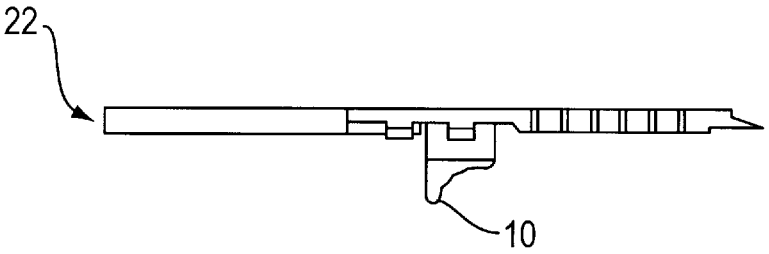
FIG. 44 is a side view of the blade carrier shown in FIG. 43.
Figure 45:
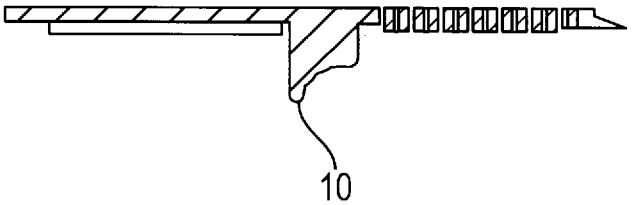
FIG. 45 is a cross-sectional view through Section 45—45 of FIG. 43.
Figure 46:
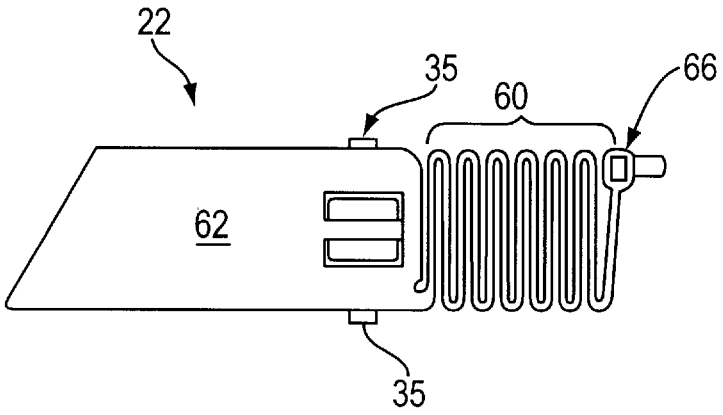
FIG. 46 is a bottom view of the blade carrier shown in FIG. 43.
Figure 47:
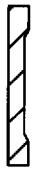
FIGS. 47–49 are cross-sectional views through the corresponding Sections shown in FIG. 43.
Figure 48:
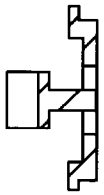
Figure 49:
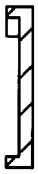

As shown in FIGS. 36–42, indexed carrier 24 includes arms 26, and a thumb piece 10 that is mounted to, and preferably integrally molded with, a central arm 40 on the blade carrier. As shown in FIG. 23, upper housing 4 includes a number of locking apertures 44 that enable the indexed blade carrier to be locked in several different positions including a fully extended position (FIG. 6), a fully retracted position (FIG. 7), and at least one intermediate position. A carrier lock 42 on central arm 40 engages with locking apertures 44. The dimensions of carrier lock 42 are just slightly smaller than locking apertures 44 so that the lock will firmly enter and lock into each aperture with little lateral movement. Central arm 40 is bent slightly and acts as a leaf spring so as to engage carrier lock 42 into locking apertures 44 with a snapping action, thereby achieving a positive locking effect. As shown in FIG. 37, thumb pressure on thumb piece 10 causes central arm 40 to temporarily bend away from the upper housing to release carrier lock 42 from locking apertures 44 and to enable the indexed carrier to be moved between its various positions. Once pressure is released from thumb piece 10, central arm 40 is biased toward the upper housing so that carrier lock 42 will engage with the next locking aperture 44 with which it becomes aligned.

Figure 29:
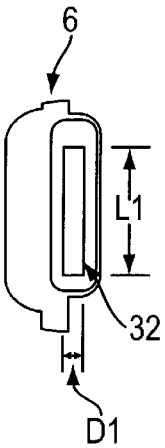
FIG. 29 is an end view of the lower housing shown in FIG. 25.

As shown in FIGS. 11–14, upper housing 4 includes a lip 46 on the front end thereof. Lip 46 is preferably integrally molded with the upper housing. Lower housing 6 includes a slot 32 on the front end thereof that is sized to enable lip 46 to be inserted therein with the upper and lower housings aligned. The length "L" of lip 46 (FIG. 14) is preferably closely sized to the interior length "L1" of slot 32 (FIG. 29) so that with the lip inserted in the slot, there is little or no lateral movement between the two halves of the housing. It will be appreciated that with lip 46 inserted in slot 32, it will still be necessary for a blade to extend through the slot. Accordingly, the thickness "D" of lip 46 (FIG. 13) and the thickness "D1" of slot 32 (FIG. 29) are sized so that there is sufficient clearance for a razor blade to extend through slot 32 with lip 46 therein.

Figure 26:
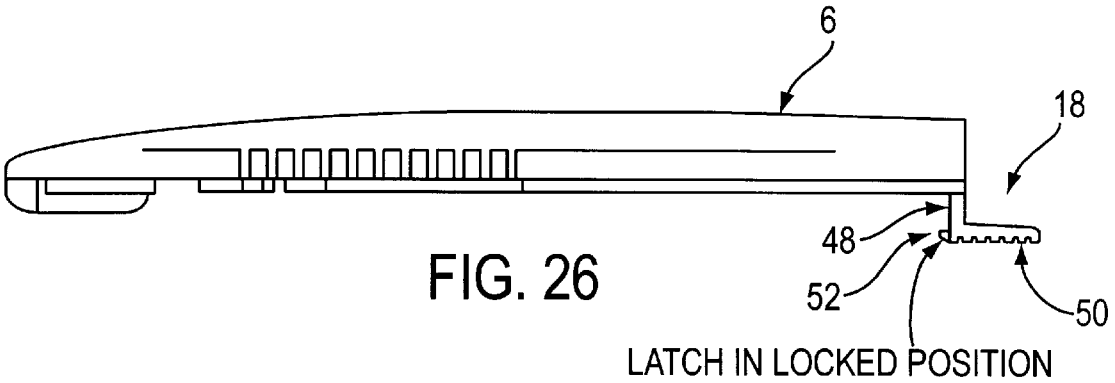
FIG. 26 is a side view of the lower housing shown in FIG. 25.
Figure 27:
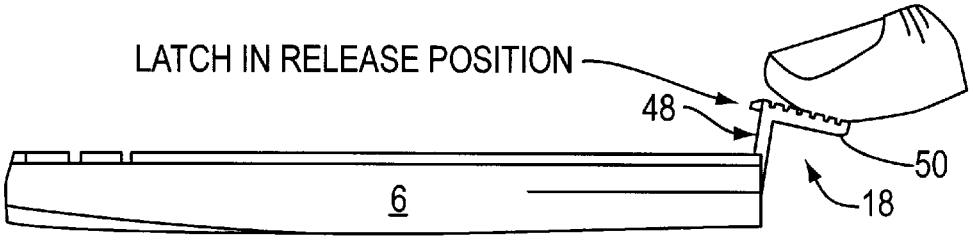
FIG. 27 is a partial opposite side view of the lower housing shown in FIG. 25.
Figure 28:
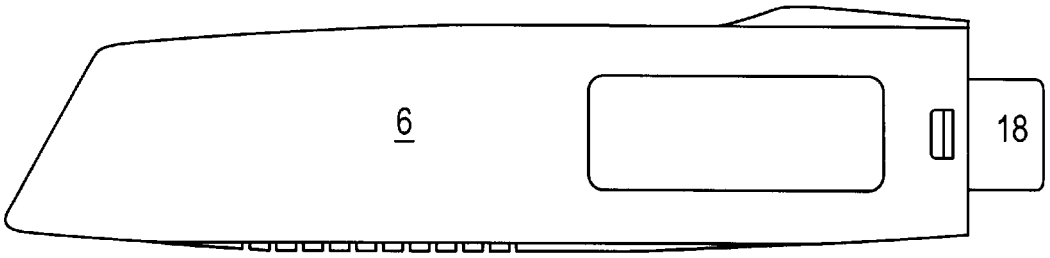
FIG. 28 is a view of the exterior side of the lower housing.
Figure 31:
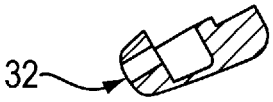
FIGS. 31–35 are cross-sectional views of the lower housing shown in FIG. 25 through the Sections corresponding to each FIG. No.
Figure 32:
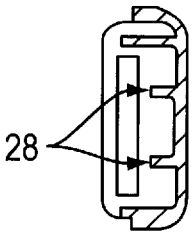
Figure 33:
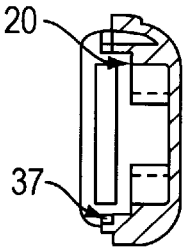
Figure 34:
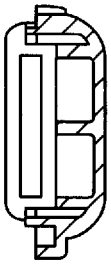
Figure 35:
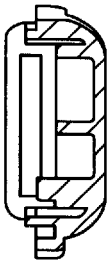

Locking of the upper housing 4 to the lower housing 6 is provided by means of a release lever 18, which is preferably integral with lower housing 6, and a release aperture 16 into which the release lever is inserted. Release lever 18 includes an upwardly-extending portion 48 that is integral with a thumb lever 50. When the release lever 18 is inserted into release aperture 16 and the upper and lower housings are pressed together in a direction generally perpendicular to the axis of the housing, i.e., generally perpendicular to the direction of blade movement within the housing, release latch 52 (FIG. 25) resiliently engages with locking lip 54 (FIG. 14) to lock the upper and lower housings together. When no downward pressure is applied to release lever 18, it returns to its resting position, as shown in FIG. 26. In order to separate the upper and lower housings so as to change a blade or the blade carrier, downward pressure is applied to thumb lever 50 thereby causing upwardly extending portion 48 to bend slightly to enable release latch 52 to clear locking lip 54 (FIG. 27). The housing may then be opened by pulling the upper and lower housings apart in a direction generally perpendicular to the axis of the housing. Once the locking mechanism has released and the rear ends of the upper and lower housings have separated, a very slight rearward movement is necessary to remove lip 46 from distal end slot 32. Thus, with the locking mechanism of the invention, the housing may be opened without the difficult movement of the upper and lower housings required in prior art locking mechanisms, such as that shown in U.S. Pat. No. 5,121,544.

Figure 8:
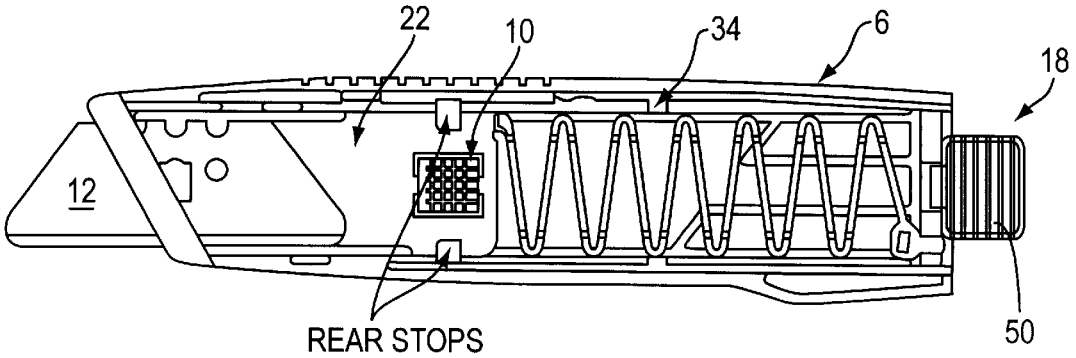
FIG. 8 is a top view of an automatically-retractable utility knife with the blade in the extended position and with the upper housing removed.
Figure 9:
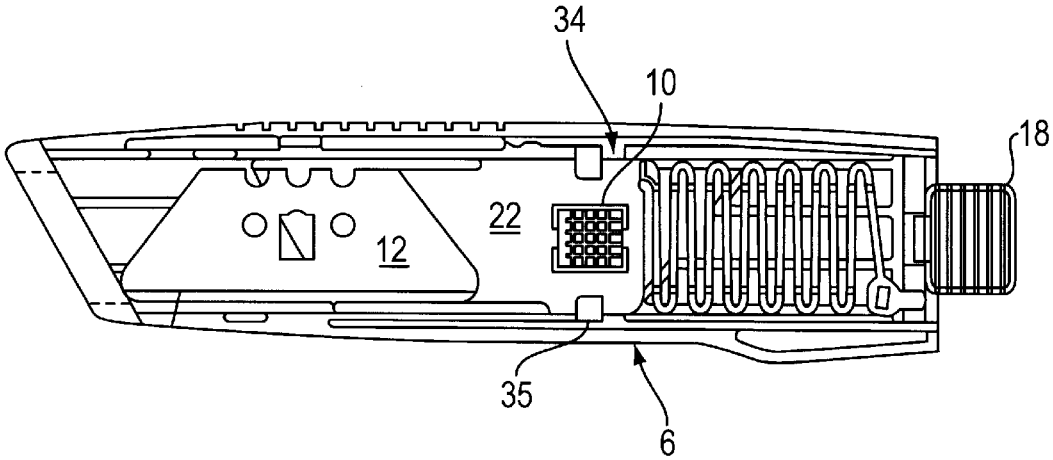
FIG. 9 is a top view of an automatically-retractable utility knife with the blade in the retracted position and with the upper housing removed.
Figure 10:
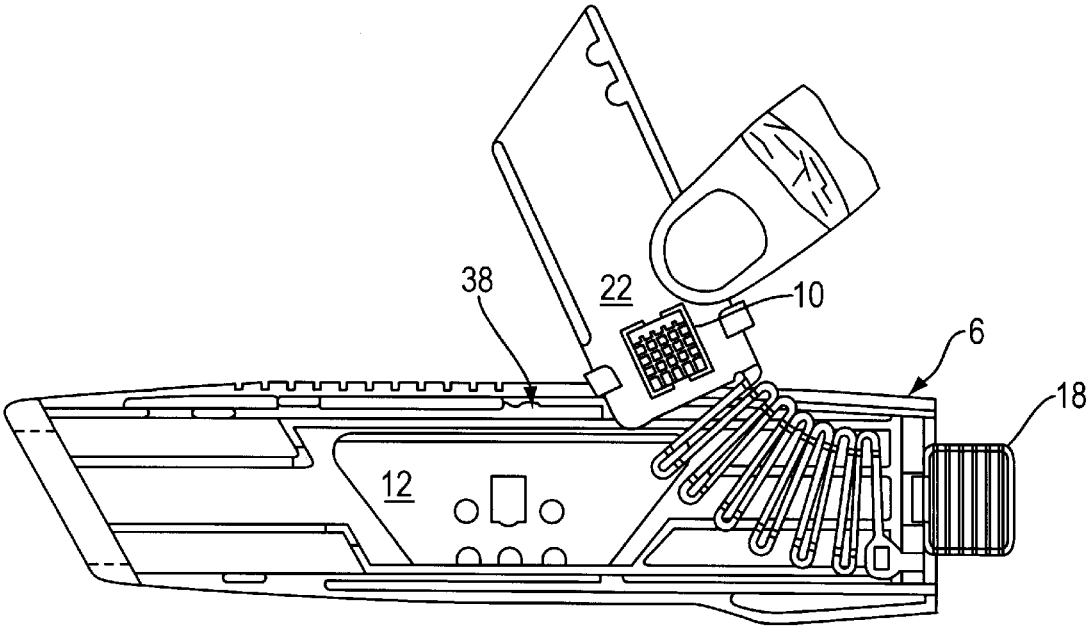
FIG. 10 is a top view of an automatically-retractable utility knife with the upper housing removed and with the blade carrier positioned to expose the spare blade holding area.
Figure 11:
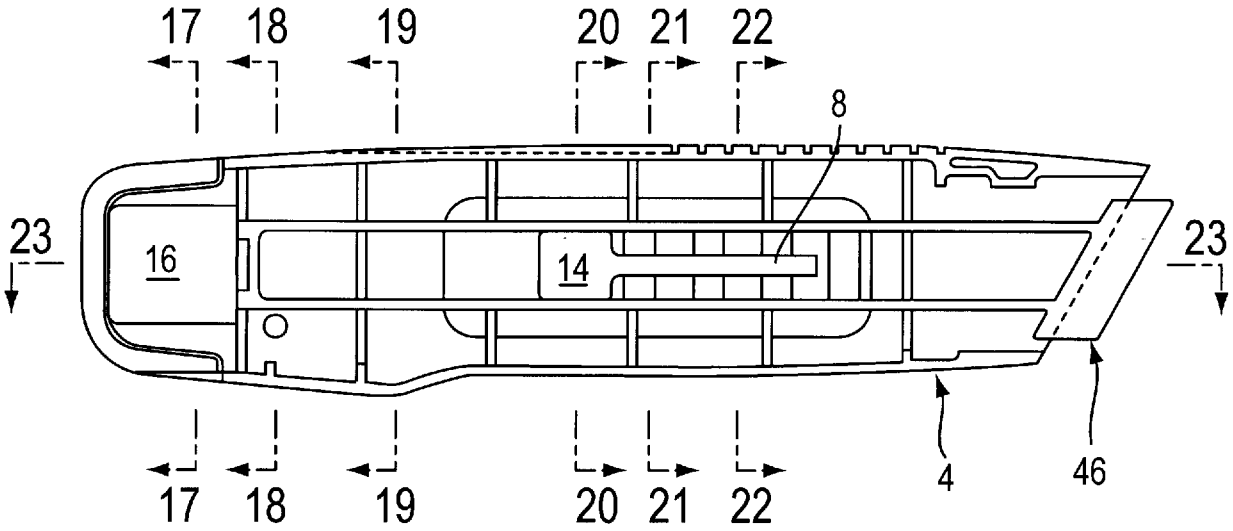
FIG. 11 is a bottom view of the upper housing of the utility knife.
Figure 12:
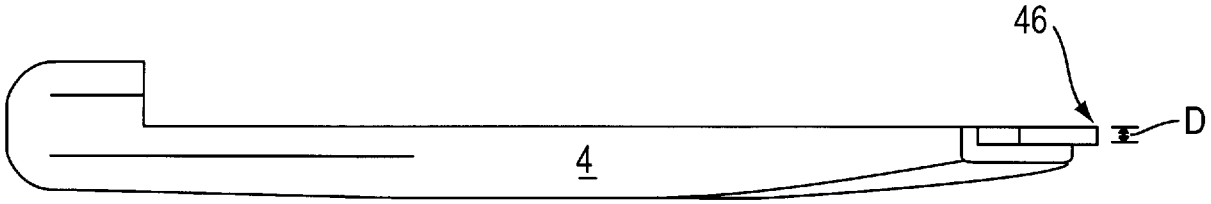
FIG. 12 is a side view of the upper housing shown in FIG. 11.
Figure 15:
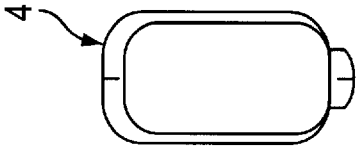
FIG. 15 is an end view of the upper housing shown in FIG. 11.
Figure 13:
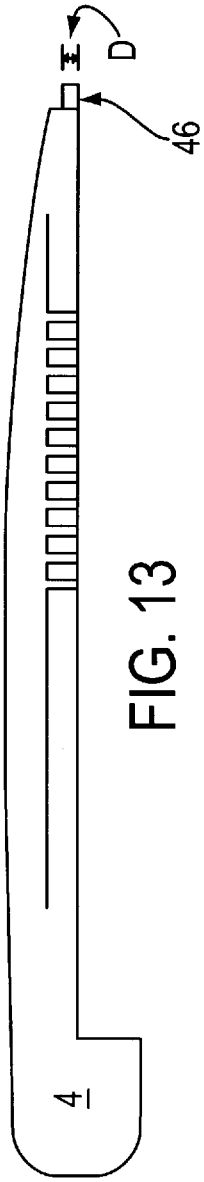
FIG. 13 is an opposite side view of the upper housing shown in FIG. 11.
Figure 14:
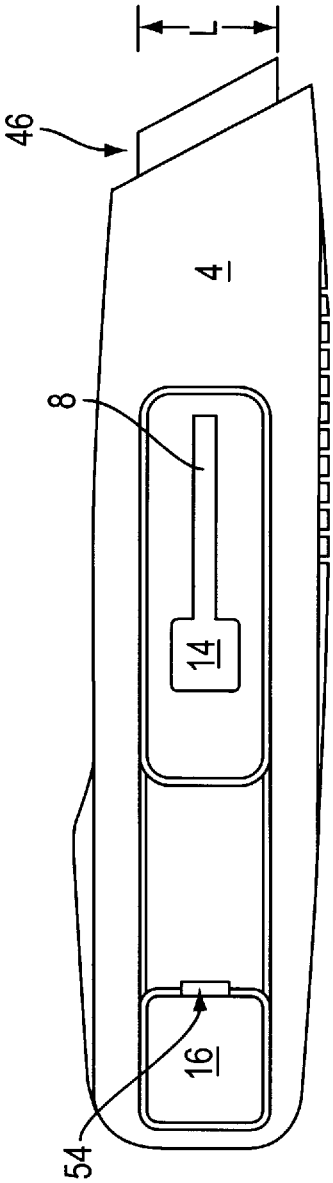
FIG. 14 is a top view of the upper housing shown in FIG. 11.
Figure 16:
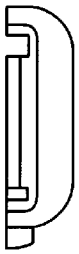
FIG. 16 is an opposite end view of the upper housing shown in FIG. 11.
Figure 17:
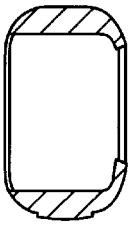
FIGS. 17–23 are cross-sectional views of the upper housing shown in FIG. 11 through the Sections corresponding to each FIG. No.
Figure 18:
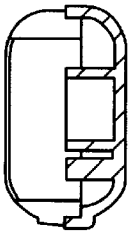
Figure 19:
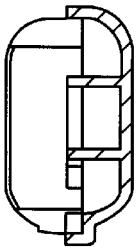
Figure 20:
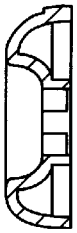
Figure 21:
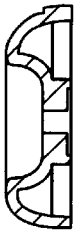
Figure 22:
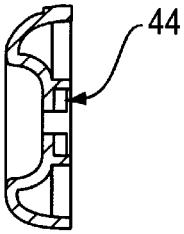
Figure 24:
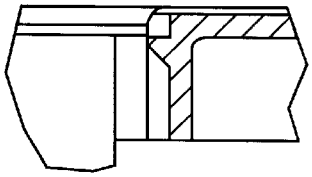
FIG. 24 is an exploded view of the circumscribed area "A" in FIG. 23.

As shown in FIGS. 8–10 and 43–49, an automatically retractable blade carrier 22 may be used with the same housing described above with respect to indexed blade carrier 24. Carrier end stops 35 engage with detents 34 to prevent rearward movement of the blade carrier beyond a full rear position. A thumb piece 10 enables the carrier to be moved within the housing for exposing and retracting the blade. A retraction spring 60, which is preferably a serpentine-shaped flat spring, is integrally molded with a base portion 62 of carrier 22. A pin 64 on lower housing 6 extends through an aperture 66 at the free end of retraction spring 60. FIG. 8 shows the automatically retractable utility knife with the carrier in the forward position, i.e., with the blade in the fully extended position. In this position, retraction spring 60 is under tension and provides a retraction force on the carrier toward the rear of the housing. Force on the thumb piece 10 causes carrier 22 to move toward the distal end of the housing, thereby placing spring 60 under additional tension and exposing blade 12. Carrier 22 is guided by slot 8, support shoulders 37, and carrier guides 20 during movement within the housing. Once the thumb piece 10 is released, retraction spring 60 automatically pulls carrier 22 toward the rear of the housing, thereby retracting blade 12 to within the housing. As shown in FIG. 10, the automatically-retractable carrier 22 may be bent outward from the housing with retraction spring 60 still mounted to pin 64 to enable spare blades to be removed from a spare blade storage area within the lower housing.

The automatically retractable blade carrier with the integral spring is manufactured by injection molding so that it is extremely economical as compared to conventional utility knives in which a separate metallic spring is used. The mold for the carrier is machined with as many zig-zags as are desired for the spring and with as many cavities as the desired number of parts to be produced in each cycle of the molding process. The acetal resin or other resilient plastic is then heated and injected in a hot liquid state into the mold as in a conventional molding process. The mold is then cooled and the completed carriers are ejected. If, for example, there are 20 cavities in a mold, and the cycle takes 15 seconds, 80 carriers per minute, with integral springs, may be produced. Because the parts are constructed of resilient plastic, they are finished, non-conductive, non-corrosive, self-lubricated and ready for assembly, immediately upon being ejected from the mold, as compared to metallic springs which must be wound, cut, looped, plated, and possibly lubricated before use.

Beside the cost factor, another advantage of using a plastic carrier is that the unused portion of the blade, i.e., the portion of the blade that remains within the housing, rests against a plastic ledge that will not dull the unused blade edge before reversing, as may occur if the blade is resting on a hardened metal carrier. Also, the acetal resin has a very low coefficient of friction so that no lubricant is needed to make the carrier slide well. Most metal carriers need grease to slide properly. However, when dirt enters the housing, it mixes with the lubricant and restricts the movement of the carrier.

The upper and lower housings are preferably constructed of any appropriate plastic material, such as ABS or high impact styrene. The blade carriers are preferably constructed of any appropriate plastic material, and more preferably are constructed of an acetal resin, such as Celcon™ or Delrin™. These materials are sufficiently resilient to provide spring force in central arm 40, in release lever 18, and in spring 60 on automatically retracting blade carrier 22. It is foreseen that the invention may be made of other types of plastics and/or any other appropriate material that is capable of performing the functions described herein. It is also foreseen that the invention may be modified to be usable with box-cutter type knives or other knives that utilize conventional rectangular razor blades.

Although the present invention has been described in detail with respect to certain embodiments and examples, variations and modifications exist which are within the scope of the present invention as defined in the following claims.

I claim:

1. A cutting device housing comprising first and second separable halves, the first half comprising a resilient locking arm, the locking arm comprising i) an upstanding portion having a first end attached to the first half of the housing and a second end, ii) an actuating arm extending laterally from the second end of the upstanding portion, whereby downward force on the actuating arm results in a bending of the upstanding portion, and iii) a locking lip on the second end of the upstanding portion extending laterally in a direction opposite to the direction of bending of the upstanding portion during downward force on the actuating arm, the second half comprising a locking aperture sized to receive the second end of the upstanding portion, and a locking shoulder adjacent to the locking aperture.

2. The cutting device housing according to claim 1 wherein the housing comprises an interior configured to receive an indexed blade carrier slidably mounted therein and to function as an indexed cutting device with the indexed blade carrier mounted therein, the housing being further configured to alternatively receive an automatically retractable blade carrier slidably mounted therein and to function as an automatically retractable cutting device with the automatically retractable carrier mounted therein.

3. The housing according to claim 2 comprising a plurality of locking apertures, in combination with an indexed blade carrier mounted within the housing, the indexed blade carrier comprising a locking protuberance that engages with the locking apertures to enable the indexed blade carrier to be moved to a plurality of positions within the housing.

4. The housing according to claim 2 comprising a spring pin, in combination with an automatically retractable blade carrier mounted within the housing and a retraction spring mounted between the automatically retractable blade carrier and the spring pin.

5. The combination according to claim 4 wherein the retraction spring and the automatically retractable blade carrier are integrally molded.

6. The housing according to claim 2 comprising a plurality of locking apertures for engaging with an indexed blade carrier and a spring pin for attachment to a retraction spring on an automatically retractable blade carrier.

7. A housing in combination with a locking mechanism which comprises:

the housing constructed of first and second separable halves, the housing having front and rear ends and an axis extending between the front and rear ends;

the locking mechanism comprising a resilient locking arm on the first half of the housing, the locking arm comprising i) an upstanding portion oriented generally perpendicular to the housing axis, the locking arm having a first end attached to the first half of the housing and a second end, ii) an actuating arm extending laterally from the second end of the locking arm, whereby downward force on the actuating arm results in a bending of the upstanding portion, and iii) a locking lip on the second end of the locking arm extending laterally in a direction opposite to the direction of bending of the upstanding portion during downward force on the actuating arm, the second half comprising a locking aperture sized to receive the second end of the locking arm, and a locking shoulder adjacent to the locking aperture, the locking arm and locking aperture being correspondingly positioned so as to become aligned when the halves of the housing are aligned for assembly, the locking arm extending into the locking aperture during assembly, the locking lip positively locking on the locking shoulder, wherein the locking mechanism is actuated by pressing the housing halves together in directions generally perpendicular to the axis of the housing, and wherein upon release of the locking mechanism by application of downward force on the actuating arm, the rear ends of the housing halves are separated by pulling in opposite directions generally perpendicular to the axis of the housing.

8. The combination according to claim 7 wherein the housing is constructed of a resilient plastic and wherein the locking mechanism is integral with the housing.

* * * * *